US011769459B2

(12) United States Patent
Oka et al.

(10) Patent No.: US 11,769,459 B2
(45) Date of Patent: Sep. 26, 2023

(54) DISPLAY DEVICE AND LIGHT-EMITTING DEVICE

(71) Applicant: Sharp Display Technology Corporation, Kameyama (JP)

(72) Inventors: Koki Oka, Kameyama (JP); Kohichi Ohhara, Kameyama (JP)

(73) Assignee: Sharp Display Technology Corporation, Mie (JP)

( * ) Notice: Subject to any disclaimer, the term of this patent is extended or adjusted under 35 U.S.C. 154(b) by 0 days.

(21) Appl. No.: 18/078,874

(22) Filed: Dec. 9, 2022

(65) Prior Publication Data

US 2023/0186863 A1 Jun. 15, 2023

(30) Foreign Application Priority Data

Dec. 14, 2021 (JP) ..... 2021-202781

(51) Int. Cl.
*G09G 3/34* (2006.01)
*G09G 3/36* (2006.01)

(52) U.S. Cl.
CPC ..... *G09G 3/3406* (2013.01); *G09G 3/3655* (2013.01); *G09G 2310/06* (2013.01); *G09G 2320/0233* (2013.01)

(58) Field of Classification Search
CPC ..... G09G 3/3406; G09G 2320/0233; G09G 3/3655; G09G 2310/06; G09G 2310/08; G09G 2320/06; G09G 2320/062
See application file for complete search history.

(56) References Cited

U.S. PATENT DOCUMENTS

| | | | | |
|---|---|---|---|---|
| 2019/0164506 | A1* | 5/2019 | Wu | G09G 3/3406 |
| 2019/0340973 | A1* | 11/2019 | Kim | G09G 3/3233 |
| 2020/0090597 | A1* | 3/2020 | Chen | G09G 3/3413 |
| 2021/0005149 | A1* | 1/2021 | Chen | G09G 3/3406 |
| 2021/0366412 | A1* | 11/2021 | Lin | G09G 3/3426 |
| 2022/0051631 | A1* | 2/2022 | Cheon | G09G 3/3233 |
| 2023/0169932 | A1* | 6/2023 | Zhang | G09G 3/3413 345/87 |

FOREIGN PATENT DOCUMENTS

| | | | |
|---|---|---|---|
| JP | 2011-075800 | A | 4/2011 |
| JP | 2013-222081 | A | 10/2013 |

* cited by examiner

*Primary Examiner* — Dennis P Joseph
(74) *Attorney, Agent, or Firm* — ScienBiziP, P.C.

(57) ABSTRACT

A display device includes a control circuit. By setting an intermediate point between a start point and an end point of a lighting period as a start point of the lighting cycle, and setting an intermediate point between a start point and an end point of a lighting period of the next lighting period as an end point of the lighting cycle, the control circuit controls a backlight such that an absolute value of a difference value between a first ratio of a sum of a length of a first lighting period in the first lighting cycle and a length of the next second lighting period in the first lighting cycle to a length of the first lighting cycle and the target duty ratio is 0.1 or less.

5 Claims, 16 Drawing Sheets

33a

| PARAMETER | Vt | Tt | Wt |
|---|---|---|---|
| Vb1, Tb1, Wb1, Va1, Ta1, Wa1 | Vt1 | Tt1 | Wt1 |
| Vb2, Tb2, Wb2, Va2, Ta2, Wa2 | Vt2 | Tt2 | Wt2 |
| ... | ... | ... | ... |

FIG. 7

233a

| PARAMETER | Vt | Tt | Wt |
|---|---|---|---|
| Vb11, Wb11, Va11, Wa11 | Vt11 | Tt11 | Wt11 |
| Vb12, Wb12, Va12, Wa12 | Vt12 | Tt12 | Wt12 |
| ... | ... | ... | ... |

FIG. 11

COMPARATIVE EXAMPLE

| | OBSERVATION RESULT |
|---|---|
| FIRST EXAMPLE | Good |
| SECOND EXAMPLE | Good |
| THIRD EXAMPLE | Good |
| FOURTH EXAMPLE | Good |
| FIFTH EXAMPLE | Good |
| SIXTH EXAMPLE | Good |
| COMPARATIVE EXAMPLE | Poor |

FIG. 15

DISPLAY DEVICE AND LIGHT-EMITTING DEVICE

CROSS-REFERENCE TO RELATED APPLICATIONS

This application claims the benefit of priority to Japanese Patent Application Number 2021-202781 filed on Dec. 14, 2021. The entire contents of the above-identified application are hereby incorporated by reference.

BACKGROUND

Technical Field

The disclosure relates to a display device and a light-emitting device.

In the related art, a display device and a light-emitting device including a light-emitting member that repeats lighting on and off are known. Such a display device is described, for example, in JP 2011-75800 A.

The display device according to JP 2011-75800 A described above includes a display control unit, a liquid crystal panel, a liquid crystal drive unit, a backlight light source, and a backlight control unit. The display control unit generates a vertical synchronization signal and a horizontal synchronization signal based on an image signal. The display control unit inputs the vertical synchronization signal and the horizontal synchronization signal to the liquid crystal drive unit and the backlight control unit. The backlight control unit intermittently lights the backlight light source within one frame period (within one vertical period) in conjunction with a writing operation of an image signal by the liquid crystal drive unit.

SUMMARY

Here, in the display device described in JP 2011-75800 A, when the length of the one vertical period is to be changed, a period during which the backlight light source lights with respect to the one vertical period (hereinafter referred to as "duty ratio in one vertical period") is constant before and after the change in order to prevent the luminance of the liquid crystal panel from being changed before and after the change. However, when the length of the one vertical period (lighting cycle of the backlight) is changed, even when the duty ratio in one vertical period is constant, a person may perceive flickering when viewing the liquid crystal panel. Note that "flickering" means that the observer (person) feels as if the luminance changes instantaneously.

Thus, the disclosure has been conceived in order to solve the problems described above and aims to provide a display device and a light-emitting device capable of suppressing flickering even in a case where a lighting cycle of a light-emitting member is changed.

In order to solve the problem described above, the inventor discovered, as a result of diligent research, that when an intermediate point between a start point and an end point of a lighting period of the light-emitting member is regarded as a "start point of the lighting cycle of the light-emitting member", and an intermediate point between a start point and an end point of a lighting period of the next lighting period is regarded as an "end point of the lighting cycle of the light-emitting member", the larger the amount of change in a ratio of the lighting period to the lighting cycle is, the more flickering that is perceived by a person. Focusing on this point, the inventor has discovered the following display device and light-emitting device. A display device according to a first aspect of the disclosure includes a display panel including a light-emitting member that repeats lighting on and off, a display control unit configured to control a length of a synchronization cycle that is a cycle of a vertical synchronization signal for driving the display panel, and a light emitting control unit configured to control a length of a lighting period that is a period during which the light-emitting member lights on and a length of a lighting cycle that is a cycle during which the light-emitting member lights on, the light emitting control unit being configured to control the light-emitting member based on a target duty ratio that is a target value of a ratio of the length of the lighting period to the length of the synchronization cycle, wherein the light emitting control unit controls the length of the lighting cycle by setting an intermediate point between a start point and an end point of the lighting period as a start point of the lighting cycle, and setting an intermediate point between a start point and an end point of a lighting period of the next lighting period as an end point of the lighting cycle, and when the length of the lighting cycle is changed from a first lighting cycle to a second lighting cycle, controls the light-emitting member such that an absolute value of a difference value between a first ratio of a sum of a length of a first lighting period in the first lighting cycle and a length of the next second lighting period in the first lighting cycle to a length of the first lighting cycle and the target duty ratio is 0.1 or less, and controls the light-emitting member such that an absolute value of a difference value between a second ratio of a sum of the length of the second lighting period in the second lighting cycle and a length of the next third lighting period in the second lighting cycle to a length of the second lighting cycle and the target duty ratio is 0.1 or less.

A display device according to a second aspect of the disclosure includes a display panel including a light-emitting member that repeats lighting on and off and a light emitting control unit configured to control a length of a lighting period that is a period during which the light-emitting member lights on and a length of a lighting cycle that is a cycle during which the light-emitting member lights on, the light emitting control unit being configured to control the light-emitting member based on a target lighting duty ratio that is a target value of a ratio of the length of the lighting period to the length of the lighting cycle, wherein the light emitting control unit controls a length of the lighting cycle by setting an intermediate point between a start point and an end point of the lighting period as a start point of the lighting cycle, and setting an intermediate point between a start point and an end point of a lighting period of the next lighting period as an end point of the lighting cycle, and when the length of the lighting cycle is changed from a first lighting cycle to a second lighting cycle, controls the light-emitting member such that an absolute value of a difference value between a first ratio of a sum of a length of a first lighting period in the first lighting cycle and a length of the next second lighting period in the first lighting cycle to a length of the first lighting cycle and the target lighting duty ratio is 0.1 or less, and controls the light-emitting member such that an absolute value of a difference value between a second ratio of a sum of the length of the second lighting period in the second lighting cycle and a length of the next third lighting period in the second lighting cycle to a length of the second lighting cycle and the target lighting duty ratio is 0.1 or less.

A light-emitting device according to a third aspect of the disclosure includes a light-emitting member that repeats lighting on and off and a light emitting control unit configured to control a length of a lighting period that is a period during which the light-emitting member lights on and a length of a lighting cycle that is a cycle during which the light-emitting member lights on, the light emitting control unit being configured to control the light-emitting member based on a target lighting duty ratio that is a target value of a ratio of the length of the lighting period to the length of the lighting cycle, wherein the light emitting control unit controls a length of the lighting cycle by setting an intermediate point between a start point and an end point of the lighting period as a start point of the lighting cycle, and setting an intermediate point between a start point and an end point of a lighting period of the next lighting period as an end point of the lighting cycle, and when the length of the lighting cycle is changed from a first lighting cycle to a second lighting cycle, controls the light-emitting member such that an absolute value of a difference value between a first ratio of a sum of a length of a first lighting period in the first lighting cycle and a length of the next second lighting period in the first lighting cycle to a length of the first lighting cycle and the target lighting duty ratio is 0.1 or less, and controls the light-emitting member such that an absolute value of a difference value between a second ratio of a sum of the length of the second lighting period in the second lighting cycle and a length of the next third lighting period in the second lighting cycle to a length of the second lighting cycle and the target lighting duty ratio is 0.1 or less.

According to the configuration described above, even in a case where the length of the lighting cycle is changed, the amount of change in the ratio of the lighting period to the lighting cycle before and after the change can be reduced, and thus flickering can be suppressed.

BRIEF DESCRIPTION OF DRAWINGS

The disclosure will be described with reference to the accompanying drawings, wherein like numbers reference like elements.

FIG. 7 is a diagram for describing a table 33*a* stored in a memory unit 33.

FIG. 11 is a diagram for describing a table 233*a* stored in a memory unit 233 according to the second embodiment.

FIG. 15 is a table illustrating observation results of the first to sixth examples and an observation result of the comparative example.

DESCRIPTION OF EMBODIMENTS

Figure 1:
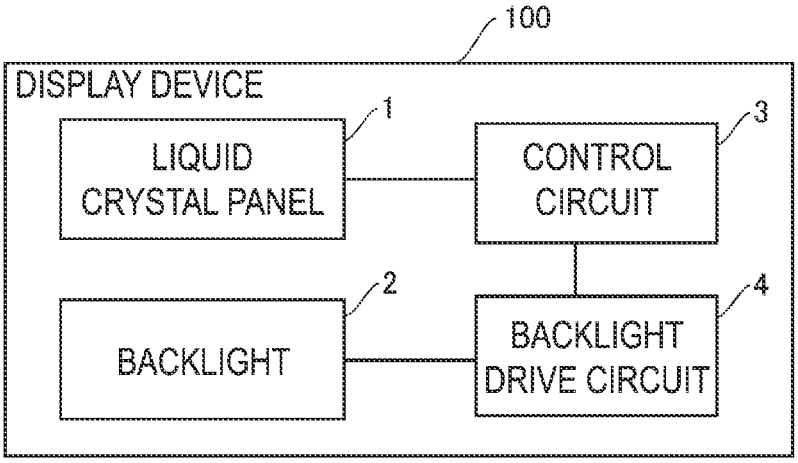
FIG. 1 is a block diagram of a display device 100 according to a first embodiment.

Embodiments of the disclosure will be described below with reference to the drawings. Note that the disclosure is not limited to the following embodiments, and appropriate design changes can be made within a scope that satisfies the configuration of the disclosure. Further, in the description below, the same reference signs are used in common among the different drawings for portions having the same or similar functions, and descriptions of repetitions thereof will be omitted. Further, the configurations described in the embodiments and the modification examples may be combined or modified as appropriate within a range that does not depart from the gist of the disclosure. Further, for ease of explanation, in the drawings referenced below, the configuration is simplified or schematically illustrated, or a portion of the components are omitted. Further, dimensional ratios between components illustrated in the drawings are not necessarily indicative of actual dimensional ratios.

First Embodiment

Overall Configuration of Display Device

FIG. 1 is a block diagram of a display device 100 according to a first embodiment. As illustrated in FIG. 1, the display device 100 includes a liquid crystal panel 1, a backlight 2, a control circuit 3, and a backlight drive circuit 4. The display device 100 can be configured as, but not limited to, any one of, for example, a head-mounted display, a television device, a smartphone, a personal computer, and a projector.

Figure 2:
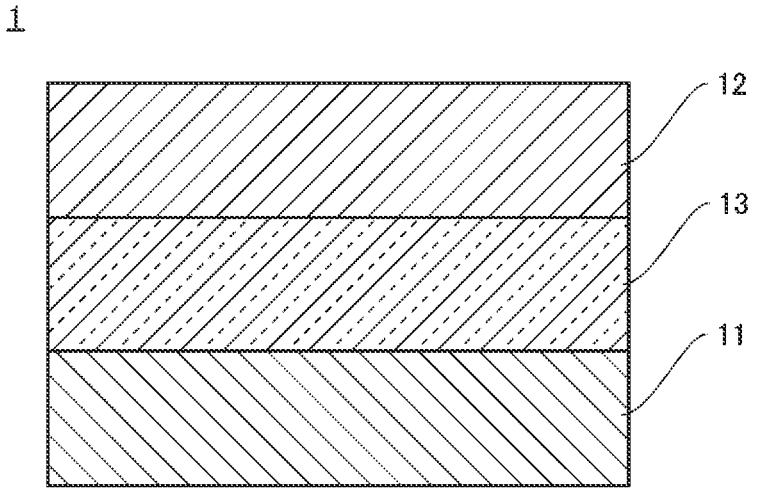
FIG. 2 is a schematical cross-sectional view of a liquid crystal panel 1.

FIG. 2 is a schematical cross-sectional view of the liquid crystal panel 1. As illustrated in FIG. 2, the liquid crystal panel 1 includes an active matrix substrate 11, a color filter substrate 12, and a liquid crystal layer 13 sandwiched between the active matrix substrate 11 and the color filter substrate 12.

Figure 3:
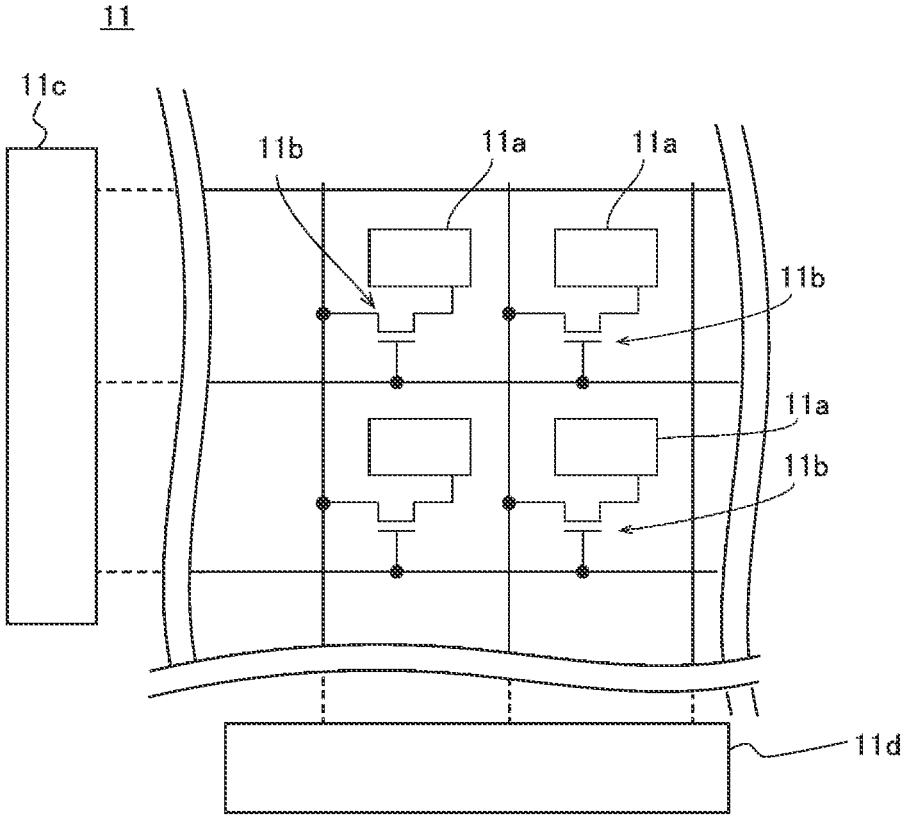
FIG. 3 is a view illustrating a configuration of a part of an active matrix substrate 11.

FIG. 3 is a view illustrating a configuration of a part of the active matrix substrate 11. As illustrated in FIG. 3, a plurality of pixel electrodes 11*a*, a counter electrode (not illustrated) disposed facing each of the plurality of pixel electrodes 11*a*, and a plurality of switching elements 11*b* are formed in the active matrix substrate 11. Further, the active matrix substrate 11 includes a gate drive circuit 11*c* that supplies a gate signal to each of the plurality of switching elements 11*b*, and a source drive circuit 11*d* that supplies a source signal to each of the plurality of pixel electrodes 11*a* via a respective one of the plurality of switching elements 11*b*. Note that the counter electrode may be disposed in the color filter substrate 12 instead of the active matrix substrate 11.

Figure 4:
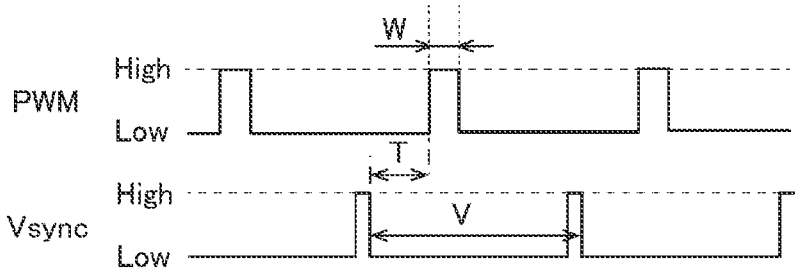
FIG. 4 is a diagram illustrating an example of impulse driving of a backlight 2.

The backlight 2 illustrated in FIG. 1 is a light-emitting member provided on a back surface or a side surface of the liquid crystal panel 1, and emits light toward the liquid crystal panel 1. The backlight 2 includes, for example, a plurality of LEDs or organic ELs. FIG. 4 is a diagram illustrating an example of impulse driving of the backlight 2. As illustrated in FIG. 4, the backlight 2 repeats lighting on and off according to a current supplied from the backlight drive circuit 4. In the first embodiment, a pulsed current is supplied to the backlight 2, and the backlight 2 is impulse driven. The backlight drive circuit 4 generates a pulse width modulation signal (PWM signal) illustrated in FIG. 4 in response to a control signal from the control circuit 3, and supplies the PWM signal to the backlight 2. Note that a waveform of the PWM signal corresponds to a waveform of a light emission intensity of the backlight 2. In FIG. 4, the backlight 2 lights on when the level of the PWM signal is "High", and the backlight 2 turns off when the level of the PWM signal is "Low".

Figure 5:
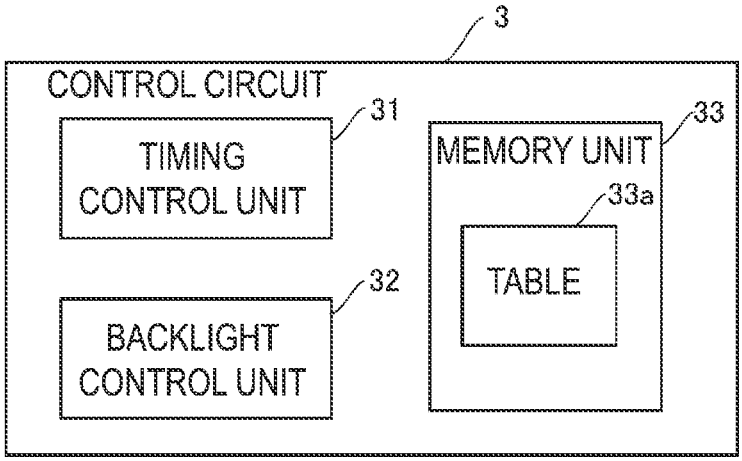
FIG. 5 is a functional block diagram of a control circuit 3.

FIG. 5 is a functional block diagram of the control circuit 3. As illustrated in FIG. 5, the control circuit 3 includes a timing control unit 31, a backlight control unit 32, and a memory unit 33. The control circuit 3 is, for example, an integrated circuit. Note that, in FIG. 5, each unit of the control circuit 3 is illustrated as a functional block, but the timing control unit 31, the backlight control unit 32, and the memory unit 33 may be configured by separate hardware (integrated circuit).

The timing control unit 31 acquires an image signal from an image receiving device (not illustrated) or an external input terminal, and generates a vertical synchronization signal and a horizontal synchronization signal based on the image signal. The timing control unit 31 supplies a control signal based on the vertical synchronization signal and the horizontal synchronization signal to the gate drive circuit 11*c* and the source drive circuit 11*d* to control driving of the liquid crystal panel 1. The timing control unit 31 switches a frequency of the vertical synchronization signal according to a frequency of the image signal and a reception status (speed of data acquisition) of the image signal. For example, the timing control unit 31 switches the frequency of the vertical synchronization signal from among 60 Hz, 72 Hz, 90 Hz, and 120 Hz. For example, when the speed of data acquisition is reduced while the timing control unit 31 is generating the vertical synchronization signal having the frequency of 120 Hz, the timing control unit 31 decreases the frequency to 90 Hz, to 72 Hz, and to 60 Hz. In other words, the timing control unit 31 changes a length of a synchronization cycle V (see FIG. 4) that is a cycle of the vertical synchronization signal Vsync (see FIG. 4). The timing control unit 31 transmits a timing signal to the backlight control unit 32. The "timing signal" is, for example, a signal in synchronization with the vertical synchronization signal Vsync. The backlight control unit 32 acquires the timing signal and synchronizes the timing signal with the vertical synchronization signal Vsync to control lighting on and off of the backlight 2. Note that the timing control is not limited to the example described above, but may be configured so that a host-side IC transmits the timing signal to the control circuit 3, and the control circuit 3 (an IC for driving the liquid crystal panel and an IC for driving the backlight) is synchronized as a slave.

Figure 6:
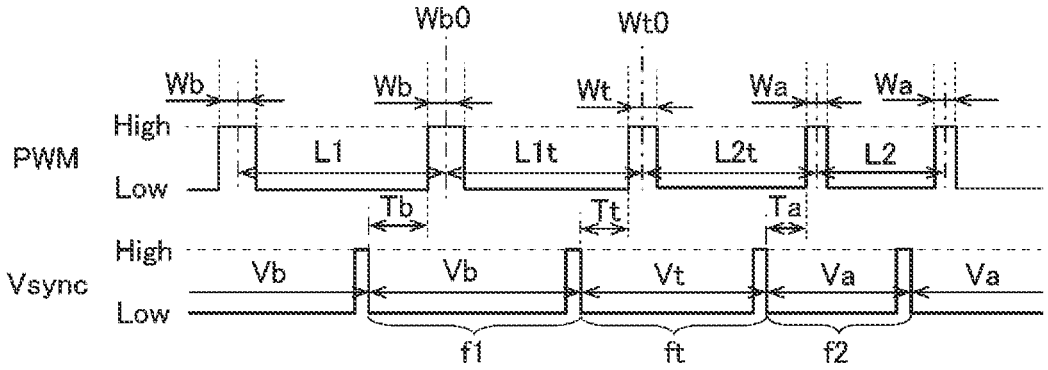
FIG. 6 is a diagram illustrating an example of a relationship between a waveform of a PWM signal supplied to the backlight 2 and a vertical synchronization signal Vsync according to the first embodiment.

FIG. 6 is a diagram illustrating an example of a relationship between a waveform of the PWM signal supplied to the backlight 2 and the vertical synchronization signal Vsync according to the first embodiment. The backlight control unit 32 controls the backlight 2 based on a target duty ratio D that is a target value of a ratio of a length of a lighting period W to the length of the synchronization cycle V. For example, the backlight control unit 32 fixes the synchronization cycle V set in advance to the frequency of the vertical synchronization signal to be operated, and adjusts the length of the lighting period W so that a current duty ratio Dp, which is a ratio of a length of a current lighting period W to the length of the synchronization cycle V, is close to the target duty ratio D. Note that when the synchronization cycle V and the lighting period W are controlled by an integer value (multiple of the number of clocks), the current duty ratio Dp may not coincide with the target duty ratio D, but the backlight control unit 32 adjusts the length of the lighting period W so that the current duty ratio Dp is close to the target duty ratio D.

Then, as illustrated in FIG. 6, the backlight control unit 32 of the display device 100 according to the first embodiment controls the length of the lighting period W and a length of a lighting cycle L that is a cycle during which the backlight 2 lights on. Here, a start point of the lighting cycle L (for example, L1*t*) is an intermediate point (for example, Wb0) between a start point and an end point of the lighting period (for example, Wb), and a start point of the lighting cycle L (for example, L2*t*) is an intermediate point (for example, Wt0) between a start point and an end point of the lighting period (for example, Wt) of the next lighting period.

Then, as illustrated in FIG. 6, the backlight control unit 32 changes the length of the lighting cycle L from L1 to L2 when the synchronization cycle V changes from Vb to Va. Here, in the first embodiment, the backlight control unit 32 changes the length of the lighting cycle L from L1 to Lt1, from Lt1 to Lt2, and from Lt2 to L2. Note that, in FIG. 6, each of Lt1 and Lt2 is illustrated to have a size different from a respective one of L1 and L2, but not limited thereto, and any of Lt1 and Lt2 may have the same size as a respective one of L1 and L2.

Additionally, as illustrated in FIG. 6, when changing the synchronization cycle V from Vb to Va, the timing control unit 31 inserts a transition frame ft between a final frame f1 in which the liquid crystal panel 1 operates according to the synchronization cycle Vb and a first frame f2 in which the liquid crystal panel 1 operates according to the synchronization cycle Va.

Then, when the length of the lighting period in the transition frame ft is Wt, the backlight control unit 32 controls lighting of the backlight 2 in a state where mathematical formulas (1) to (3) are satisfied. That is, the backlight control unit 32 sets Wt, L1*t*, and L2*t* such that an absolute value of a difference value (R1−D) between a ratio R1 and the target duty ratio D is 0.1 or less, and an absolute value of a difference value (R2−D) between a ratio R2 and the target duty ratio D is 0.1 or less. As a result, even in a case where the length of the lighting cycle L is changed, the amount of change in the ratio of the lighting period to the lighting cycle L before and after the change can be reduced, and thus flickering can be suppressed.

[Expression 1]

$$\frac{\frac{Wb}{2}+\frac{Wt}{2}}{L1t}=R1 \tag{1}$$

[Expression 2]

-continued $$\frac{\frac{Wt}{2}+\frac{Wa}{2}}{L2t}=R2 \tag{2}$$

[Expression 3]

$$|R1-D|\leq 0.1,\ |R2-D|\leq 0.1 \tag{3}$$

In the first embodiment, the backlight control unit 32 determines, based on the vertical synchronization signal Vsync and the target duty ratio D, the length of the lighting period W, the length of the lighting cycle L, and a length T of a period from the start point of the synchronization cycle to the start point of the lighting period (see FIG. 4). Here, as illustrated in FIG. 6, the above mathematical formulas (1) and (2) become the following mathematical formulas (5) and (6) in a state where the following mathematical formula (4) is satisfied, where Tb is a period from the start point of the synchronization cycle Vb to the start point of the lighting period having the length Wb, Vt is a length of the transition frame ft, Tt is a period from the start point of the transition frame ft to the start point of the lighting period having the length Wt, and Ta is a period from the start point of the synchronization cycle having the length Va to the start point of the lighting period having the length Wa. That is, in the first embodiment, the backlight control unit 32 controls the lighting of the backlight 2 so as to satisfy the above mathematical formula (3) and the following mathematical formulas (4) to (6).

[Expression 4]

$$Tt>0,\ Tt+Wt<Vt \tag{4}$$

[Expression 5]

$$\frac{\frac{Wb}{2}+\frac{Wt}{2}}{Vb-Tb-\frac{Wb}{2}+Tt+\frac{Wt}{2}}=R1 \tag{5}$$

[Expression 6]

$$\frac{\frac{Wt}{2}+\frac{Wa}{2}}{Vt-Tt-\frac{Wt}{2}+Ta+\frac{Wa}{2}}=R2 \tag{6}$$

According to this configuration, in a case where the driving of the liquid crystal panel 1 and the light emission of the backlight 2 are performed in synchronization with each other, even in a case where the length of the synchronization cycle V is changed, and the length of the lighting cycle L in synchronization with the synchronization cycle V changes, the amount of change in the ratio of the lighting period W to the lighting cycle L before and after the change can be reduced. Further, by setting each parameter Vt, Tt, and Wt of the transition frame ft so as to satisfy the above mathematical formulas, each parameter can be appropriately set so that each of the absolute value of the difference value (R1–D) and the absolute value of the difference value (R2–D) of the ratio of the lighting period to the lighting cycle L are reduced.

In the first embodiment, the length Vt of the transition frame ft is equal to Vb. For example, as a result, even when the transition frame ft is provided, types of length of the vertical synchronization signal Vsync do not increase, and thus a configuration for generating the vertical synchronization signal Vsync in the display device 100 can be simplified. Note that the length Vt of the transition frame ft may be equal to Va instead of Vb.

In the first embodiment, the backlight control unit 32 determines Wt to be between Wb and Wa. That is, in a case of Wb<Wa, Wb<Wt<Wa is satisfied, and in a case of Wb>Wa, Wb>Wt>Wa is satisfied. Accordingly, since the amount of change between Wb and Wt and the amount of change between Wt and Wa can be reduced, occurrence of flickering due to the amount of change in the length of the lighting period W can be prevented.

In (4) to (6) above, after Tt and Wt are set once so that the absolute value of the difference value (R1–D) is 0.1 or less, and the absolute value of the difference value (R2–D) between the ratio R2 and the target duty ratio D is 0.1 or less, Tt may be further adjusted within the range of ±0.05×Vt, and Wt may be further adjusted within the range of ±0.05×Vt. This "adjustment" may be performed for the purpose of making it difficult to visually recognize flickering, or may be performed for suppressing "moving picture blur" due to lighting of the backlight 2 during operation of the liquid crystal layer 13.

FIG. 7 is a diagram for describing a table 33*a* stored in a memory unit 33. As illustrated in FIG. 7, for example, each parameter satisfying the above mathematical formulas (3) to (6) is stored in the memory unit 33 in advance. For example, Vt, Tt, and Wt are stored in association with Vb, Tb, Wb, Va, Ta, and Wa in the memory unit 33 as the table 33*a*. The backlight control unit 32 acquires information about Vb, Tb, Wb, Va, Ta, and Wa, and refers to the memory unit 33 and determines Vt, Tt, and Wt based on the information about Vb, Tb, Wb, Va, Ta, and Wa. For example, in a case where Vb=Vb1, Tb=Tb1, Wb=Wb1, Va=Va1, Ta=Ta1, and Wa=Wa1, the backlight control unit 32 refers to the memory unit 33, and determines that Vt=Vt1, Tt=Tt1, and Wt=Wt1.

Second Embodiment

Next, a configuration of the display device 200 according to a second embodiment will be described with reference to FIGS. 8 to 11. In the second embodiment, unlike the configuration of the first embodiment in which the backlight 2 is driven in synchronization with the vertical synchronization signal, a backlight 202 is driven without being in synchronization with the vertical synchronization signal. Note that, in the following description, when the same reference numerals as those in the first embodiment are used, similar configurations to those in the first embodiment are indicated, and reference is made to the preceding description unless otherwise described.

Figure 8:
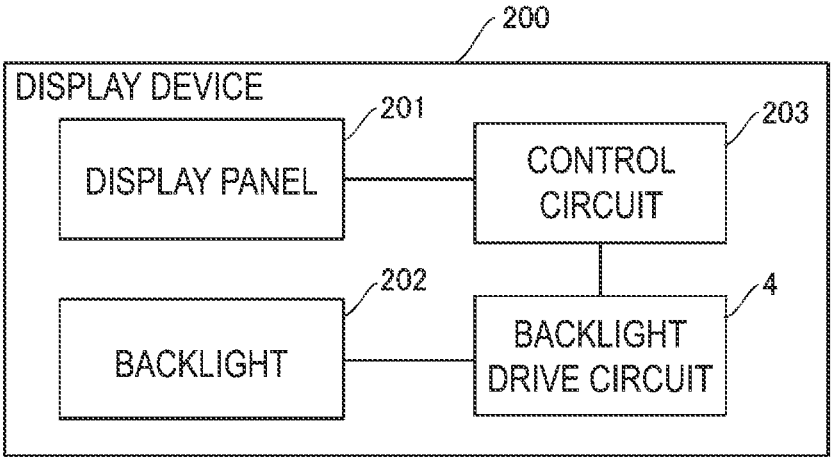
FIG. 8 is a block diagram of a display device 200 according to a second embodiment.

FIG. 8 is a block diagram of the display device 200 according to the second embodiment. As illustrated in FIG. 8, the display device 200 includes a display panel 201, a backlight 202, and a control circuit 203. The display panel 201 is a display that does not use the vertical synchronization signal. The display panel 201 may be, but is not limited to, for example, a memory in pixel display in which image information is stored in each pixel, or may be simply a sheet on which an image is printed. The backlight 202 is, for example, a plurality of LEDs or organic ELs.

Figure 9:
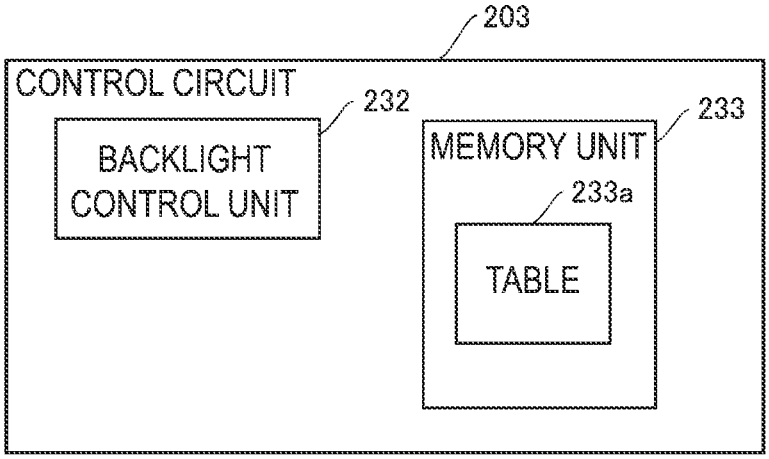
FIG. 9 is a functional block diagram of a control circuit 203 according to the second embodiment.

FIG. 9 is a functional block diagram of the control circuit 203 according to the second embodiment. The control circuit 203 includes a backlight control unit 232 and a memory unit 233. In the second embodiment, the backlight control unit 232 controls the length of the lighting cycle L and the length of the lighting period W without being in synchronization with the vertical synchronization signal. For example, the backlight control unit 232 controls the backlight 202 based on a target lighting duty ratio DL that is a target value of a ratio of the length of the lighting period W to the length of the lighting cycle L.

Figure 10:
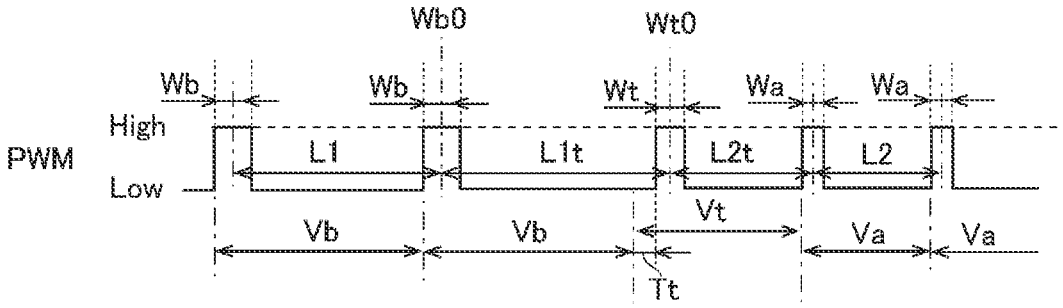
FIG. 10 is a diagram illustrating an example of a waveform of a PWM signal for controlling lighting of a backlight 202 according to the second embodiment.

FIG. 10 is a diagram illustrating an example of a waveform of a PWM signal for controlling lighting of the backlight 202 according to the second embodiment. As illustrated in FIG. 10, the backlight control unit 232 drives the backlight 202 so as to satisfy the following mathematical formulas (7) to (9) and (10), where Tb=Ta=0 in the mathematical formulas (4) to (6) according to the first embodiment. Note that, in the second embodiment, since there is no vertical synchronization signal, the backlight control unit 232 performs control so that the start point of Vb and the start point of Va coincide with the start point of Wb and the start point of Wa, respectively.

[Expression 7]

$$Tt > 0,\ Tt + Wt < Vt \tag{7}$$

[Expression 8]

$$\frac{\frac{Wb}{2} + \frac{Wt}{2}}{Vb - \frac{Wb}{2} + Tt + \frac{Wt}{2}} = R11 \tag{8}$$

[Expression 9]

$$\frac{\frac{Wt}{2} + \frac{Wa}{2}}{Vt - Tt - \frac{Wt}{2} + \frac{Wa}{2}} = R12 \tag{9}$$

[Expression 10]

$$|R11 - DL| \leq 0.1,\ |R12 - DL| \leq 0.1 \tag{10}$$

FIG. 11 is a diagram for describing a table 233*a* stored in the memory unit 233 according to the second embodiment. For example, the backlight control unit 232 adjusts the length of the lighting period W with respect to a cycle V set to the frequency of the backlight 202 in advance, and control the backlight 202 so that a current lighting duty ratio DLp is close to the target lighting duty ratio DL. Note that when the cycle V and the lighting period W are controlled by an integer value (multiple of the number of clocks), the current lighting duty ratio DLp may not coincide with the target lighting duty ratio DL, but the backlight control unit 232 adjusts the length of the lighting period W so that the current lighting duty ratio DLp is close to the target lighting duty ratio DL. As illustrated in FIG. 11, for example, each parameter satisfying the above mathematical formulas (7) to (10) is stored in the memory unit 233 in advance. For example, Vt, Tt, and Wt are stored in association with Vb, Wb, Va, and Wa in the memory unit 233 as the table 233*a*. When the length of the lighting cycle L is changed, the backlight control unit 232 refers to the memory unit 233 and determines Vt, Tt, and Wt based on the information about Vb, Wb, Va, and Wa. For example, in a case where Vb=Vb11, Wb=Wb11, Va=Va11, and Wa=Wall, the backlight control unit 232 refers to the memory unit 233, and determines that Vt=Vt11, Tt=Tt11, and Wt=Wt11. As a result, even in the display device 200 using the display panel 201 that does not use the vertical synchronization signal, flickering can be prevented. Note that other configurations are the same as the configurations according to the first embodiment.

Third Embodiment

Next, a configuration of a display device 300 of a third embodiment will be described with reference to FIGS. 12 and 13. In the third embodiment, the cycle is changed to any synchronization cycle for each frame unlike the configuration of the first embodiment in which the cycle is changed by a predetermined synchronization cycle (frequency of 60 Hz, 72 Hz, 90 Hz, and 120 Hz). Note that, in the following description, when the same reference numerals as those in the first embodiment are used, similar configurations to those in the first embodiment are indicated, and reference is made to the preceding description unless otherwise described.

Figure 12:
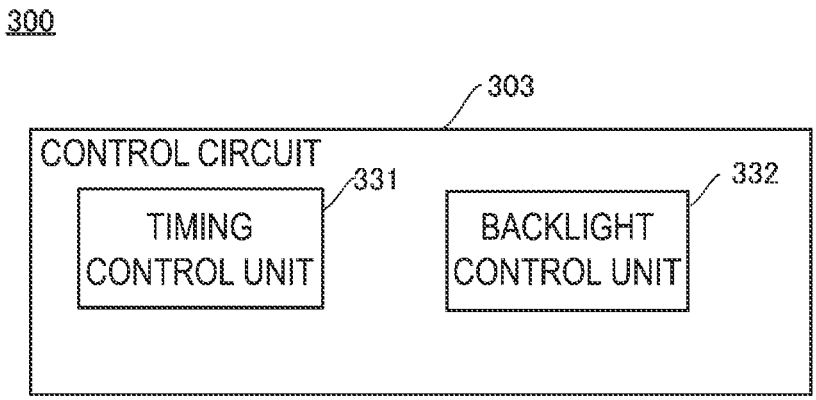
FIG. 12 is a block diagram illustrating a configuration of a display device 300 according to a third embodiment.

FIG. 12 is a block diagram illustrating a configuration of the display device 300 according to the third embodiment. As illustrated in FIG. 12, the display device 300 includes a control circuit 303. The control circuit 303 includes a timing control unit 331 and a backlight control unit 332. In the third embodiment, the timing control unit 331 sets the synchronization cycle V to any value according to the image signal. For example, the timing control unit 331 changes the synchronization cycle V for each frame. The backlight control unit 332 changes the lighting cycle L according to the change in the synchronization cycle V.

Figure 13:
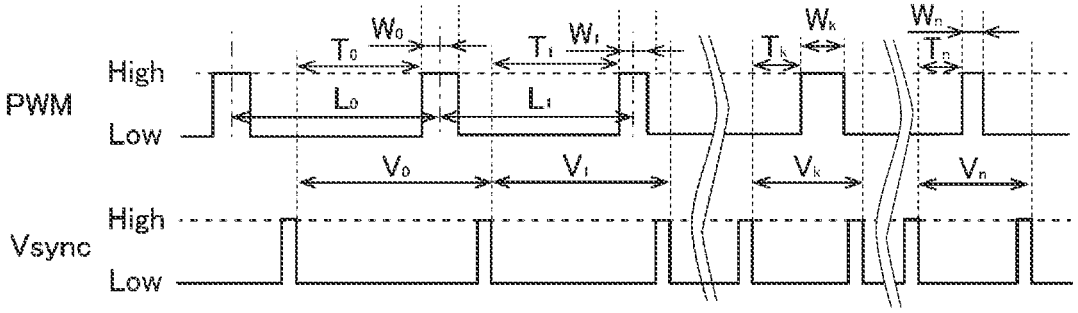
FIG. 13 is a diagram illustrating an example of a waveform of a PWM signal and a waveform of a vertical synchronization signal Vsync according to the third embodiment.

FIG. 13 is a diagram illustrating an example of the waveform of the PWM signal and the waveform of the vertical synchronization signal Vsync according to the third embodiment. Here, a first frame is defined as a 0-th frame, a frame at the point in time when the synchronization cycle V is switched k times is defined as a k-th frame, and a final frame is defined as an n-th frame. Here, k and n are natural numbers, and 1≤k≤n. In the third embodiment, the backlight control unit 332 controls the backlight 2 in a state where the following mathematical formulas (11) to (13) are satisfied. For example, the backlight control unit 332 sets initial values of $T_0$ and $W_0$, and sets each parameter determined based on the following mathematical formulas (11) to (13), based on synchronization cycles $V_1$ to $V_n$, an absolute value of a difference value between a ratio $R3_1$ and the target duty ratio D, an absolute value of a difference value between a ratio $R3_2$ and the target duty ratio D, an absolute value of a difference value between a ratio $R3_3$ and the target duty ratio D, . . . , an absolute value of a difference value between a ratio $R3_{n-1}$ and the target duty ratio D, and absolute values of a difference value between a ratio $R3_n$ and the target duty ratio D. Note that $T_k$ and $W_k$ may be set once in a state where the following mathematical formulas (11) to (13) are satisfied, and then may be further changed within a range of ±5% of $V_k$.

[Expression 11]

$$T_k > 0,\ T_k + W_b < V_b \tag{11}$$

-continued

[Expression 12]

$$\begin{cases} \dfrac{\dfrac{W_0}{2}+\dfrac{W_1}{2}}{V_0-T_0-\dfrac{W_0}{2}+T_1+\dfrac{W_1}{2}}=R3_1 \\ \dfrac{\dfrac{W_1}{2}+\dfrac{W_2}{2}}{V_1-T_1-\dfrac{W_1}{2}+T_2+\dfrac{W_2}{2}}=R3_2 \\ \cdots \\ \dfrac{\dfrac{W_{k-1}}{2}+\dfrac{W_k}{2}}{V_{k-1}-T_{k-1}-\dfrac{W_{k-1}}{2}+T_k+\dfrac{W_k}{2}}=R3_k \\ \cdots \\ \dfrac{\dfrac{W_{n-1}}{2}+\dfrac{W_n}{2}}{V_{n-1}-T_{n-1}-\dfrac{W_{n-1}}{2}+T_n+\dfrac{W_n}{2}}=R3_n \end{cases} \tag{12}$$

[Expression 13]

$$|R3_1-D|\leq 0.1,\ |R3_2-D|\leq 0.1,\ |R3_k-D|\leq 0.1,\ |R3_n-D|\leq 0.1 \tag{13}$$

As a result, even in the display device 300 in which the synchronization cycle V is changed to any cycle for each frame, flickering can be prevented. Note that other configurations are the same as the configurations according to the first embodiment.

Comparison Result with Comparative Example

Figure 14:
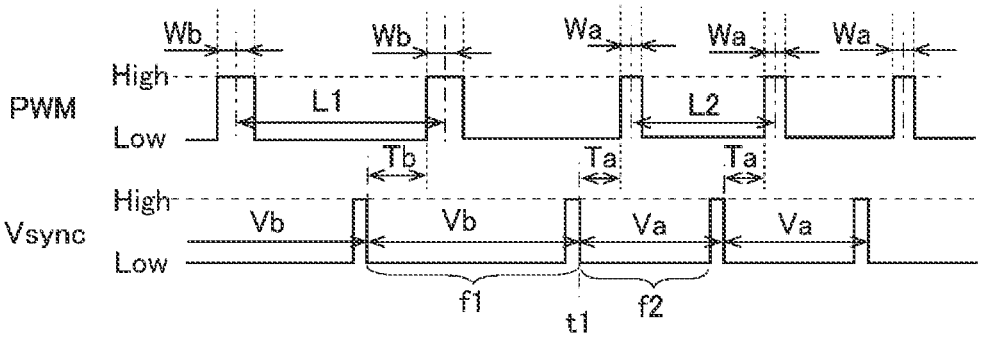
FIG. 14 is a diagram illustrating an example of a relationship between a waveform of a PWM signal and a waveform of a vertical synchronization signal according to a display device according to a comparative example.

FIG. 14 is a diagram illustrating an example of a relationship between a waveform of a PWM signal and a waveform of a vertical synchronization signal according to a display device according to a comparative example. FIG. 15 is a table illustrating observation results of the first to fifth examples and an observation result of the comparative example. Note that the configurations of the display device according to the comparative example are exemplified in order to explain the actions and the effects of the display device according to the first to third embodiments, and not all configurations of the display device according to the comparative example are recognized as the related art. In the display device according to the comparative example, a waveform of a current to the backlight is controlled so that the target duty ratio D (=W/V), which is the target value of the ratio of the length of the lighting period W to the synchronization cycle V (one vertical period), is constant.

Here, as illustrated in FIG. 14, in a case where the synchronization cycle V was reduced from Vb to Va, an observer visually recognized the liquid crystal panel of the display device according to the comparative example and confirmed the presence or absence of flickering (the observer felt as if the luminance changed instantaneously). In the display device according to the comparative example, when changing from a frame displayed at the synchronization cycle Vb to a frame displayed at the synchronization cycle Va (in particular, at a point in time t1), flickering occurred on the liquid crystal panel (see FIG. 15).

Thus, the inventor calculated an absolute value of a difference value between a ratio R4 of the following mathematical formula (14) and the target duty ratio D, and an absolute value of a difference value between a ratio R5 of the following mathematical formula (15) and the target duty ratio D, in a case where flickering is felt, and the absolute value of the difference value between the ratio R5 and the target duty ratio D was a value that was greater than 0.1.

[Expression 14]

$$\frac{Wb}{Vb}=R4 \tag{14}$$

[Expression 15]

$$\frac{\dfrac{Wb}{2}+\dfrac{Wa}{2}}{Vb-Tb-\dfrac{Wb}{2}+Ta+\dfrac{Wa}{2}}=R5 \tag{15}$$

Thus, as a first example of the display device 100 according to the first embodiment, the observer confirmed light from the backlight 2 transmitted through the liquid crystal panel 1 and confirmed the presence or absence of flickering in a state where the above mathematical formula (4) was satisfied, and in a state where the backlight 2 was controlled so that the absolute value of the difference value between the ratio R1 of the above mathematical formula (5) and the target duty ratio D, and the absolute value of the difference value between the ratio R2 of the above mathematical formula (6) and the target duty ratio D, respectively, were 0.1. As illustrated in FIG. 15, in the display device 100 according to the first example, no flickering was felt (flickering was reduced as compared with the case of the comparative example). Further, as a second example of the display device 100 according to the first embodiment, the observer confirmed light from the backlight 2 transmitted through the liquid crystal panel 1 and confirmed the presence or absence of flickering in a state where the backlight 2 was controlled so that the absolute value of the difference value between the ratio R1 of the above mathematical formula (5) and the target duty ratio D, and the absolute value of the difference value between the ratio R2 of the above mathematical formula (6) and the target duty ratio D were 0.01. As illustrated in FIG. 15, in the display device 100 according to the second example, no flickering was felt (flickering was reduced as compared with the case of the comparative example).

Further, as a third example of the display device 200 according to the second embodiment, the observer confirmed light from the backlight 202 and confirmed the presence or absence of flickering in a state where the above mathematical formula (7) was satisfied, and in a state where the backlight 202 was controlled so that the absolute value of the difference value between the ratio R11 of the above mathematical formula (8) and the target lighting duty ratio DL and the absolute value of the difference value between the ratio R12 of the above mathematical formula (9) and the target lighting duty ratio DL were respectively 0.1. As illustrated in FIG. 15, in the display device 200 according to the third example, no flickering was felt (flickering was reduced as compared with the case of the comparative example). Further, as a fourth example of the display device 200 according to the second embodiment, the observer confirmed light from the backlight 202 and confirmed the presence or absence of flickering in a state where the above mathematical formula (7) was satisfied, and in a state where the backlight 202 was controlled so that the absolute value of the difference value between the ratio R11 of the above mathematical formula (8) and the target lighting duty ratio DL and the absolute value of the difference value between the ratio R12 of the above mathematical formula (9) and the target lighting duty ratio DL were respectively 0.01. As illustrated in FIG. 15, in the display device 200 according to the fourth example, no flickering was felt (flickering was reduced as compared with the case of the comparative example).

Further, as a fifth example of the display device 300 according to the third embodiment, the observer confirmed light from the backlight 2 and confirmed the presence or absence of flickering in a state where the backlight 2 was controlled so that an absolute value of a difference value between a ratio $R3_1$ and the target duty ratio D, an absolute value of a difference value between a ratio $R3_2$ and the target duty ratio D, an absolute value of a difference value between a ratio $R3_3$ and the target duty ratio D, . . . , an absolute value of a difference value between a ratio $R3_{n-1}$ and the target duty ratio D, and absolute values of a difference value between a ratio $R3_n$ and the target duty ratio D of the above mathematical formulas (11) and (12) were respectively 0.1. As illustrated in FIG. 15, in the display device 300 according to the fifth example, no flickering was felt (flickering was reduced as compared with the case of the comparative example). Further, as a sixth example of the display device 300 according to the third embodiment, the observer confirmed light from the backlight 2 and confirmed the presence or absence of flickering in a state where the backlight 2 was controlled so that an absolute value of a difference value between a ratio $R3_1$ and the target duty ratio D, an absolute value of a difference value between a ratio $R3_2$ and the target duty ratio D, an absolute value of a difference value between a ratio $R3_3$ and the target duty ratio D, . . . , an absolute value of a difference value between a ratio $R3_{n-1}$ and the target duty ratio D, and absolute values of a difference value between a ratio $R3_n$ and the target duty ratio D of the above mathematical formulas (11) and (12) were respectively 0.01. As illustrated in FIG. 15, in the display device 300 according to the sixth example, no flickering was felt (flickering was reduced as compared with the case of the comparative example).

As described above, in the display device according to the first to third embodiments, even in a case where the length of the lighting cycle is changed, flickering can be suppressed before and after the change.

Embodiments and examples have been described above, but the embodiments and the examples described above are merely examples for implementing the disclosure. Thus, the disclosure is not limited to the embodiments and the examples described above and can be implemented by modifying the embodiments and the examples described above as appropriate without departing from the scope of the disclosure.

Figure 16:
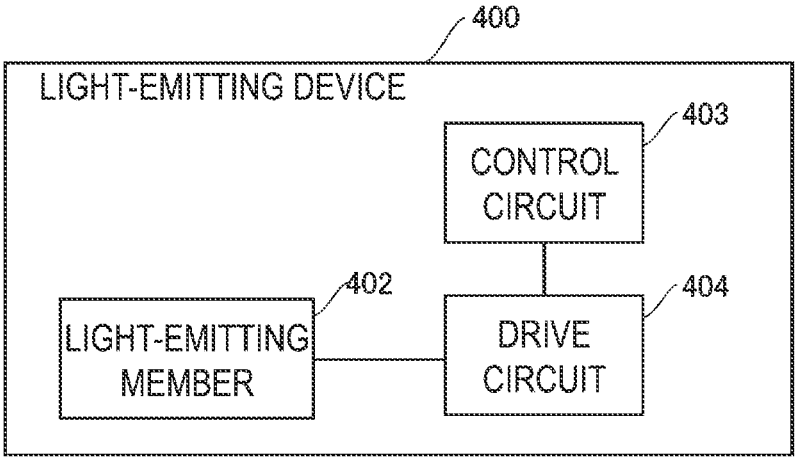
FIG. 16 is a block diagram illustrating a configuration of a light-emitting device 400 according to a modification example of the first to third embodiments.

(1) Although examples of the display device are given in the first to third embodiments described above, the disclosure is not limited to these examples. That is, the liquid crystal panel need not be provided as in the light-emitting device 400 according to a first modification example illustrated in FIG. 16. For example, the light-emitting device 400 may be configured as an illumination device. The light-emitting device 400 according to the first modification example includes a light-emitting member 402, a control circuit 403, and a drive circuit 404. The light-emitting member 402 is, for example, an LED or an organic EL. The drive circuit 404 supplies a pulsed current to the light-emitting member 402 in response to a command from the control circuit 403. Similar to the control circuit 3 of the first embodiment described above, the control circuit 403 controls the lighting of the light-emitting member 402 in a state where mathematical formulas (1) to (3) are satisfied when the lighting cycle L of the light-emitting member 402 is changed from L1 to L2. As a result, even in the light-emitting device 400, flickering can be suppressed.

(2) In the first embodiment described above, an example is illustrated in which the display device is configured to include the liquid crystal panel and the backlight, but the disclosure is not limited to this example. For example, the lighting of the organic EL panel may be controlled in a manner similar to that of the first embodiment described above.

(3) In the first embodiment described above, an example is illustrated in which when the synchronization cycle is changed, one transition frame is inserted between the frames before and after the change, but the disclosure is not limited to this example. That is, when the synchronization cycle is changed, a plurality of transition frames may be inserted between the frames before and after the change.

(4) In the first and second embodiments described above, an example is illustrated in which the backlight control unit refers to the memory unit to determine each parameter of the transition frame, but the disclosure is not limited to this example. For example, the backlight control unit may calculate each parameter of the transition frame by calculating the above mathematical formulas (3) to (6) or the above mathematical formulas (3) and (7) to (10).

The display device and the light-emitting device described above can be described as follows.

A display device according to a first configuration includes a display panel including a light-emitting member that repeats lighting on and off, a display control unit configured to control a length of a synchronization cycle that is a cycle of a vertical synchronization signal for driving the display panel, and a light emitting control unit configured to control a length of a lighting period that is a period during which the light-emitting member lights on and a length of a lighting cycle that is a cycle during which the light-emitting member lights on, the light emitting control unit being configured to control the light-emitting member based on a target duty ratio that is a target value of a ratio of the length of the lighting period to the length of the synchronization cycle, wherein the light emitting control unit controls a length of the lighting cycle by setting an intermediate point between a start point and an end point of the lighting period as a start point of the lighting cycle, and setting an intermediate point between a start point and an end point of a lighting period of the next lighting period as an end point of the lighting cycle, and when the length of the lighting cycle is changed from a first lighting cycle to a second lighting cycle, controls the light-emitting member such that an absolute value of a difference value between a first ratio of a sum of a length of a first lighting period in the first lighting cycle and a length of the next second lighting period in the first lighting cycle to a length of the first lighting cycle and the target duty ratio is 0.1 or less, and controls the light-emitting member such that an absolute value of a difference value between a second ratio of a sum of the length of the second lighting period in the second lighting cycle and a length of the next third lighting period in the second lighting cycle to a length of the second lighting cycle and the target duty ratio is 0.1 or less (first configuration).

According to the first configuration described above, even in a case where the length of the lighting cycle is changed, the amount of change in the ratio of the lighting period to the lighting cycle before and after the change can be reduced, and thus flickering can be suppressed.

In the first configuration, the display control unit may be configured to insert a transition frame between a final frame in which the display panel operates according to a first synchronization cycle and a first frame in which the display panel operates according to a second synchronization cycle when the display control unit changes the length of the synchronization cycle from the first synchronization cycle to the second synchronization cycle, and the light emitting control unit may be configured to control the light-emitting member in synchronization with the vertical synchronization signal, change the length of the lighting cycle from the first lighting cycle to the second lighting cycle when the length of the synchronization cycle is changed from the first synchronization cycle to the second synchronization cycle by the display control unit, and change the length of the lighting cycle from the first lighting cycle to the second lighting cycle in the transition frame (second configuration).

According to the second configuration described above, in a case where the driving of the display panel and the light emission of the light-emitting member are performed in synchronization with each other, even in a case where the length of the synchronization cycle is changed, and the length of the lighting cycle in synchronization with the synchronization cycle changes, change of the length of the lighting cycle from the first lighting cycle to the second lighting cycle is executed in the transition frame, and thus the amount of change in the ratio of the lighting period to the lighting cycle before and after the change can be reduced.

In the second configuration, the light emitting control unit may be configured to control lighting of the light-emitting member in a state where mathematical formulas (4) to (6) are satisfied where the target duty ratio is D, the length of the first synchronization cycle is Vb, the period from the start point of the first synchronization cycle to the start point of the first lighting period is Tb, the length of the first lighting period is Wb, the length of the transition frame is Vt, the period from the start point of the transition frame to the start point of the second lighting period is Tt, the length of the second lighting period is Wt, the length of the second synchronization cycle is Va, the period from the start point of the second synchronization cycle to the start point of the third lighting period is Ta, and the length of the third lighting period is Wa (third configuration).

According to the third configuration described above, each parameter Vt, Tt, and Wt of the transition frame can be appropriately set so that the amount of change in the ratio of the lighting period to the lighting cycle is reduced.

In the second or third configuration, the length of the transition frame may be set equal to either the length of the first synchronization cycle or the length of the second synchronization cycle (fourth configuration).

According to the fourth configuration described above, even in a case where the transition frame is provided, types of length of the vertical synchronization signal do not increase, and thus a configuration for generating the vertical synchronization signal can be simplified.

In at least one of the second to fourth configurations, the light emitting control unit may be configured to determine the length of the second lighting period to be a length between the length of the first lighting period and the length of the third lighting period (fifth configuration).

According to the fifth configuration described above, the amount of change between the length of the first lighting period and the length of the second lighting period, and the amount of change between the length of the second lighting period and the length of the third lighting period can be respectively reduced. Occurrence of flickering due to the amount of change in the length of the lighting period can be prevented.

A display device according to a sixth configuration includes a display panel including a light-emitting member that repeats lighting on and off and a light emitting control unit configured to control a length of a lighting period that is a period during which the light-emitting member lights on and a length of a lighting cycle that is a cycle during which the light-emitting member lights on, the light emitting control unit being configured to control the light-emitting member based on a target lighting duty ratio that is a target value of a ratio of the length of the lighting period to the length of the lighting cycle, wherein the light emitting control unit controls a length of the lighting cycle by setting an intermediate point between a start point and an end point of the lighting period as a start point of the lighting cycle, and setting an intermediate point between a start point and an end point of a lighting period of the next lighting period as an end point of the lighting cycle, and when the length of the lighting cycle is changed from a first lighting cycle to a second lighting cycle, controls the light-emitting member such that an absolute value of a difference value between a first ratio of a sum of a length of a first lighting period in the first lighting cycle and a length of the next second lighting period in the first lighting cycle to a length of the first lighting cycle and the target lighting duty ratio is 0.1 or less, and controls the light-emitting member such that an absolute value of a difference value between a second ratio of a sum of the length of the second lighting period in the second lighting cycle and a length of the next third lighting period in the second lighting cycle to a length of the second lighting cycle and the target lighting duty ratio is 0.1 or less (sixth configuration).

Also according to the sixth configuration described above, similarly to the first configuration described above, even in a case where the length of the lighting cycle is changed, the amount of change in the ratio of the lighting period to the lighting cycle before and after the change can be reduced, and thus flickering can be suppressed.

A light-emitting device according to a seventh configuration includes a light-emitting member that repeats lighting on and off and a light emitting control unit configured to control a length of a lighting period that is a period during which the light-emitting member lights on and a length of a lighting cycle that is a cycle during which the light-emitting member lights on, the light emitting control unit being configured to control the light-emitting member based on a target lighting duty ratio that is a target value of a ratio of the length of the lighting period to the length of the lighting cycle, wherein the light emitting control unit controls a length of the lighting cycle by setting an intermediate point between a start point and an end point of the lighting period as a start point of the lighting cycle, and setting an intermediate point between a start point and an end point of a lighting period of the next lighting period as an end point of the lighting cycle, and when the length of the lighting cycle is changed from a first lighting cycle to a second lighting cycle, controls the light-emitting member such that an absolute value of a difference value between a first ratio of a sum of a length of a first lighting period in the first lighting cycle and a length of the next second lighting period in the first lighting cycle to a length of the first lighting cycle and the target lighting duty ratio is 0.1 or less, and controls the light-emitting member such that an absolute value of a difference value between a second ratio of a sum of the length of the second lighting period in the second lighting cycle and a length of the next third lighting period in the second lighting cycle to a length of the second lighting cycle and the target lighting duty ratio is 0.1 or less (seventh configuration).

According to the seventh configuration described above, even in a case where the length of the lighting cycle is changed, the light-emitting device capable of suppressing flickering can be provided.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A display device comprising:

a display panel including a light-emitting member that repeats lighting on and off;

a display control unit configured to control a length of a synchronization cycle that is a cycle of a vertical synchronization signal for driving the display panel; and a light emitting control unit configured to control a length of a lighting period that is a period during which the light-emitting member lights on and a length of a lighting cycle that is a cycle during which the light-emitting member lights on, the light emitting control unit being configured to control the light-emitting member based on a target duty ratio that is a target value of a ratio of the length of the lighting period to the length of the synchronization cycle, wherein the light emitting control unit controls the length of the lighting cycle by setting an intermediate point between a start point and an end point of the lighting period as a start point of the lighting cycle, and setting an intermediate point between a start point and an end point of a lighting period of the next lighting period as an end point of the lighting cycle, and when the length of the lighting cycle is changed from a first lighting cycle to a second lighting cycle, controls the light-emitting member such that an absolute value of a difference value between a first ratio of a sum of a length of a first lighting period in the first lighting cycle and a length of a next second lighting period in the first lighting cycle to a length of the first lighting cycle and the target duty ratio is 0.1 or less, and controls the light-emitting member such that an absolute value of a difference value controls the light-emitting member such that an absolute value of a difference value between a second ratio of a sum of the length of the next second lighting period in the second lighting cycle and a length of a next third lighting period in the second lighting cycle to a length of the second lighting cycle and the target duty ratio is 0.1 or less.

2. The display device according to claim 1, wherein the display control unit inserts a transition frame between a final frame in which the display panel operates according to a first synchronization cycle and a first frame in which the display panel operates according to a second synchronization cycle when the display control unit changes the length of the synchronization cycle from the first synchronization cycle to the second synchronization cycle, and the light emitting control unit controls the light-emitting member in synchronization with the vertical synchronization signal, changes the length of the lighting cycle from the first lighting cycle to the second lighting cycle when the length of the synchronization cycle is changed from the first synchronization cycle to the second synchronization cycle by the display control unit, and changes the length of the lighting cycle from the first lighting cycle to the second lighting cycle in the transition frame.

3. The display device according to claim 2, wherein the light emitting control unit controls lighting of the light-emitting member in a state where mathematical formulas (1) to (4) are satisfied,

[Expression 16]

$$Tt > 0,\ Tt + Wt < Vt \tag{1}$$

[Expression 17]

$$\frac{\frac{Wb}{2} + \frac{Wt}{2}}{Vb - Tb - \frac{Wb}{2} + Tt + \frac{Wt}{2}} = R1 \tag{2}$$

[Expression 18]

$$\frac{\frac{Wt}{2} + \frac{Wa}{2}}{Vt - Tt - \frac{Wt}{2} + Ta + \frac{Wa}{2}} = R2 \tag{3}$$

[Expression 19]

$$|R1 - D| \leq 0.1,\ |R2 - D| \leq 0.1 \tag{4}$$

where the target duty ratio is D, a length of the first synchronization cycle is Vb, a period from a start point of the first synchronization cycle to a start point of the first lighting period is Tb, the length of the first lighting period is Wb, a length of the transition frame is Vt, a period from a start point of the transition frame to a start point of the next second lighting period is Tt, the length of the next second lighting period is Wt, a length of the second synchronization cycle is Va, a period from a start point of the second synchronization cycle to a start point of the next third lighting period is Ta, and a length of the next third lighting period is Wa.

4. The display device according to claim 2, wherein a length of the transition frame is equal to either a length of the first synchronization cycle or a length of the second synchronization cycle.

5. The display device according to claim 1, wherein the light emitting control unit determines the length of the next second lighting period to be a length between the length of the first lighting period and the length of the next third lighting period.

* * * * *